US010556148B2

(12) United States Patent
Paulson et al.

(10) Patent No.: US 10,556,148 B2
(45) Date of Patent: Feb. 11, 2020

(54) CONVEYOR CHAIN FOR A STEPMILL

(71) Applicant: True Fitness Technology, Inc., O'Fallon, MO (US)

(72) Inventors: Jordan Paulson, Glen Carbon, IL (US); Jared Kueker, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 108 days.

(21) Appl. No.: 15/922,585

(22) Filed: Mar. 15, 2018

(65) Prior Publication Data

US 2018/0272183 A1 Sep. 27, 2018

Related U.S. Application Data

(60) Provisional application No. 62/471,780, filed on Mar. 15, 2017.

(51) Int. Cl.
*A63B 22/04* (2006.01)
*A63B 22/02* (2006.01)

(52) U.S. Cl.
CPC ..... *A63B 22/04* (2013.01); *A63B 22/0285* (2013.01)

(58) Field of Classification Search
CPC ..... A63B 22/02; A63B 22/0285; A63B 22/04; B66B 23/08–12; B66B 21/01–02; B65G 17/06–086; B65G 17/34
See application file for complete search history.

(56) References Cited

U.S. PATENT DOCUMENTS

| | | | | |
|---|---|---|---|---|
| 2012/0264572 | A1 | 10/2012 | Fenster et al. | |
| 2014/0187387 | A1 | 7/2014 | Fenster et al. | |
| 2016/0367851 | A1* | 12/2016 | Astilean | B62K 7/00 |
| 2017/0014673 | A1 | 1/2017 | Andrade | |
| 2017/0246500 | A1* | 8/2017 | Gatti | A63B 21/15 |
| 2017/0348559 | A1 | 12/2017 | Andrade | |
| 2018/0326256 | A1* | 11/2018 | Coray | A63B 22/025 |

FOREIGN PATENT DOCUMENTS

| | | | |
|---|---|---|---|
| KR | 200396992 | Y1 | 9/2005 |
| KR | 1020080021744 | A | 3/2008 |
| KR | 101623683 | B1 | 5/2016 |

OTHER PUBLICATIONS

International Search Report, International Patent Application No. PCT/US2018/022702, dated Jul. 2, 2018 (18 pages).

* cited by examiner

*Primary Examiner* — Jennifer M Deichl
(74) *Attorney, Agent, or Firm* — Lewis Rice LLC

(57) ABSTRACT

A conveyor chain which is designed to be used on a stepmill to form into steps on the side interacting with a user, but which can fold into a generally flat configuration when returning to the top of the tread. Each step is designed to be formed of four generally identical segments where both the segments forming the tread and kickplate can fold relative to each other and each of the tread and kickplate can fold at a midpoint between two segments.

20 Claims, 3 Drawing Sheets

CONVEYOR CHAIN FOR A STEPMILL

CROSS REFERENCE TO RELATED APPLICATION(S)

This Application claims the benefit of U.S. Provisional Patent Application Ser. No. 62/471,780, filed Mar. 15, 2017, the entire disclosure of which is incorporated herein by reference.

BACKGROUND

1. Field of the Invention

This disclosure relates to the field of cardiovascular exercise machines. In particular, to a conveyor chain for treadmills which are designed to provide a moving staircase. These are often referred to as stepmills.

2. Description of the Related Art

The benefits of regular aerobic exercise on individuals of any age are well documented in fitness science. Aerobic exercise can dramatically improve cardiac stamina and function, as well as lead to weight loss, increased metabolism, and other benefits. At the same time, aerobic exercise has often been linked to damaging effects, particularly to joints or similar structures, where the impact from many aerobic exercise activities can cause injury. Therefore, those involved in the exercise industry are continuously seeking ways to provide users with exercises that have all the benefits of aerobic exercise, without the damaging side effects.

One relatively low impact exercise is walking. Walking has a number of advantages over its faster relative, running. In particular, walking causes much less stress on body structures in the legs, feet, and hips. In a walking motion, the human body generally never completely leaves the ground while, in a running motion, the body is suspending midair for a short period of time with each stride. Thus, while walking, knees and other structures absorb an impact from the foot's contact with a surface, but the entire weight of the individual is generally not absorbed by the body as it is in running. For this reason, walking is generally an acceptable exercise for a large number of people and even for the elderly and those with joint or other issues. Further, the impact of walking can be further reduced by walking on a treadmill or other exercise device as opposed to walking outside. The tread of a treadmill can be purposefully engineered to absorb and reduce impact from footfalls, making the walking motion produce even less impact on the body.

Walking as an exercise, however, has a number of built-in limitations and these can be exaggerated when one is intending to walk on a machine in the home or gym such as a treadmill. Many of the problems relate to walking's built in limitations for strenuousness. The average human will generally naturally walk around 3 to 3.5 miles per hour and most humans cannot walk above 4 to 5 miles per hour without specific training. Generally, at higher speeds, the person has to switch to a running motion in order to maintain the desired speed. It is often accepted that speeds between 4 and 6 miles per hour require the average human to jog, while speeds above 6 miles per hour require a running motion. Humans can obtain very fast speeds while running with an average person being able to sprint at over 10 miles per hour. Further, some studies have indicated that any person's natural walking speed may be preferentially selected to minimize work for desired distance and time. Thus, natural walking as an exercise can be problematic because humans may naturally walk in a very efficient fashion, which can minimize its exercise potential.

While a sustained walking speed of 4 mph can prove plenty strenuous for many people, for those looking for weight loss and strong cardiovascular workouts, walking, even at their top sustainable speed, can require a very long workout to be equivalent to a relatively short run and the time for such a workout may not be available. The time required by walking can be particularly problematic for home exercise machines where the average user can find walking in-place for a long period of time boring since there is no changing scenery or people to talk to.

For those who are interested in using an exercise machine for strenuous walking, the common way to increase the strenuousness of the activity is to increase the incline of the tread forcing them to consistently walk "uphill" or engage in more of a hiking or climbing exercise. Walking at even a relatively slight angle above neutral (or level) has been shown to dramatically increase the strenuousness of the walking. However, traditional treadmills often have problems producing higher inclines. Specifically, traditional treadmills could generally only obtain a maximum incline of around 10-15 percent.

To go to higher inclines, many workout machines will transition from the standard smooth running belt of a treadmill to a conveyor chain that is designed to simulate steps. These are often referred to as "stepmills". The act of going up stairs has been long known to be a vigorous exercise because it not only requires moving the body (where moving the body mass provides the resistance) horizontally, but vertically in a near equal amount. Further, walking up a staircase as an exercise generally causes the person doing it to work multiple of their large lower body muscles. This is an effective way to burn calories, build muscle mass, and sculpt one's appearance. Further, stair climbing also assists in working on balance since the person's mass is generally being lifted by a single leg at a time and provides an intense cardio workout due to its difficulty.

Originally, those interested in performing stair workouts would simply utilize a convenient flight of stairs. Probably the most memorable stair workout occurs in the movie "Rocky" with Rocky Balboa running up the 72 stone steps in front of the Philadelphia Museum of Art to evocative music and raising his hands in triumph at the end. That scene, which is considered by many as one of the greatest scenes in movie making, may have even served as the inspiration for a resurgence in stair climbing as an exercise. Even today, stair-climbing races are popular fundraisers in a number of cities and many fitness trackers will separately track stair climbing.

While running or walking up an actual staircase can be a highly effective workout, it does present a reasonably high danger of falling, can be of limited interest and availability due to a limited number of stair steps available in a home or even gym setting, and can be difficult in inclement weather if the staircase is outside. For that reason, the concept of stepmills seek to provide what is essentially an endless staircase indoors to allow for a similar exercise to be performed in limited space and over a longer period of time.

Originally, stepmills operated along the same basic principle as the escalator moving stairway which is a venerable design generally considered in its modern form to date back over 100 years and in older forms almost 200 as evidenced by documents such as U.S. Pat. Nos. 25,076; 406,314; and 479,864. People just simply use the structure of escalators in reverse by attempting to walk up a staircase that is actually moving down. The stair operation of many stepmills has also been traditionally similar where the stairs each comprise a solid component "block" mounted on a chain. Each of the blocks is generally triangular in cross-section and includes a generally 90-degree corner on the user facing side with one of the faces on the opposing side. A chain is then used to interconnect and mount the faces together. In this way, when the chain is arranged at an angle, the blocks form a series of steps. A user is supported on the chain by simply supporting the blocks on a truss system and platform that serves to hold the user's body weight.

While this structure is highly effective for an escalator to move people between floors of a building, it actually has some major problems in conjunction with an exercise device. The most notable of which is its vertical size. Because the stair chain needs to be an endless loop, the height of a stepmill chain is generally substantial. In particular, the base is commonly quite high off the ground as the chain and blocks need to clear the floor a sufficient distance to allow the full size of each block to not impact the floor as it goes around under the device and under the chain part being used. Further, the top portion of the device is generally defined by the number of steps the device has. As a step is commonly between 8 and 12 inches, to have even a small number of steps be available to the user (for example 4), the top of the top block will commonly be more than 4 feet off the ground. To deal with this some manufacturers broke the step into two components, a tread and a kickplate, which could rotate about each other but were individually quite thin. While this allowed the components to generally arrange themselves in a more co-planar arrangement when returning under the step arrangement, the original height still had to be sufficient to allow the kickplate and tread to turn the bottom corner closest to the floor. Thus, while the initial height did not have to be double the stair rise, it was often still at least a single rise and often more.

A second problem created by these kind of stepmills is the difficulty in getting on and off them. In an escalator, the landing platform at the bottom is actually suspended above the working elements of the escalator and the escalator belt actually extends under the floor. This allows the belt to have a different angle at the discharge end that causes the blocks to slide together so their upper surfaces form a generally co-planar flat surface across multiple stairs. This allows a user to step on or off without having to step up or down. In a stepmill machine, however, this is generally not possible as the machine cannot be built into the floor, but needs to rest on the floor.

Thus, getting on the machine commonly requires a user to step up the distance of at least one, and often more, stairs to get on the machine. This can be uncomfortable. Further, it can create a fairly major safety situation as if a user was to inadvertently go too far back on the machine and the stair tilted out from under them as it went around the lower corner and began its turn to return to the top, the user has a rather substantial distance to fall off the lowest step which can lead to major injury.

Because of these and other similar problems, the stepmill fell out of favor for gyms and home exercise. Instead, it was replaced by a "stepper" or a machine that utilized pneumatic or hydraulic resisted levers to simulate stair movement in the legs. In these systems, the user would lift their foot on a lever that would then be pushed up by a piston at generally the same rate they moved against the base of their foot. Upon, reaching the top of the "step", the user would then push the lever down against the piston to provide the exercise stroke, while simultaneously raising their other foot. In this way, a "high step" kind of motion similar to that of stair stepping was created. While this was an effective exercise, it was not actually stair climbing as the user did not actually lift their full mass with each step. Instead, the majority of resistance was actually provided by contracting the piston which their mass assisted with.

Stepper machines have also fallen out of favor due to them not being particularly comfortable to use since the motion is somewhat unnatural and have been replaced more by elliptical machines or standing bikes that utilize a rotational motion instead of the multiple levers reducing impact on the body but provide a similar "high step" type motion. The stepmill, however, has begun to see a comeback with one of its modern counterparts having become quite common. That is the endless ladder. The endless ladder is not climbing on stairs where the foot is placed on a flat horizontal surface, but by climbing on cylindrical rungs. As the rungs can be much smaller than the stair tread and can be circular in diameter, the step of a rung is much smaller than a traditional step. This allows the base of the machine to be much closer to the ground. However, the motion of an endless ladder can be a bit uncomfortable and unnatural as one is commonly climbing at an angle and the user's full foot does not contact the rung. Further, because an endless ladder requires a user to use their hands on a "higher" rung to stabilize themselves, the tread of these devices are often very long meaning that while they may not have as much vertical height to horizontal height as a stepmill, they often require even more space to handle their large tread and rotating the base through multiple angles.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a conveyor chain which is designed to be used on a stepmill to form into steps on the side interacting with a user, but which can fold into a flat configuration when returning to the top of the tread. Each step can also fold at a midpoint of both the tread and kickplate and is comprised of four identical segments. This allows both the tread and kickplate of the step to break in half when rotating about the top and bottom of the belt path. In this way, the system provides for an endless step belt when acted on by a user, but requires much less space under the tread for return and rotation as the lowest tread can be closer to the floor. Such arrangement allows the stepmill to be smaller, particularly in its vertical dimension, and presents a reduced safety hazard should a user fall off the stepmill as the distance of fall is less.

There is described herein, among other things, a conveyor chain for a stepmill, the chain comprising: a plurality of segments, each of said segments comprising a main body in the shape of a trapezoidal prism, said main body including: a top surface; a bottom surface smaller than said top surface and generally parallel thereto; an angled face interconnecting said top surface and said bottom surface; and an edge also interconnecting said top surface and said bottom surface; wherein, said edge and said angled face are not parallel to each other; and wherein said edge has a plurality of eyelets arranged thereon; a plurality of axial rods; and a plurality of hinges; wherein, said plurality of segments are arranged into a conveyor chain with: a first segment from said plurality of segments connected to a second segment from said plurality of segments to form a tread, said first segment and said second segment being connected by a first hinge from said plurality of hinges arranged at a bottom surface of said first segment and a top surface of said second segment so that the angled faces of said first segment and said second segment can alternatively be in contact with each other and not in contact with each other; a third segment from said plurality of segments connected to a fourth segment from said plurality of segments to form a kickplate, said third segment and said fourth segment being connected by a second hinge from said plurality of hinges arranged at a top surface of said third segment and a bottom surface of said fourth segment so that the angled faces of said third segment and said fourth segment can alternatively be in contact with each other and not in contact with each other; said tread and said kickplate connected together to form a link, said tread and said kickplate being connected by a first axial rod from said plurality of axial rods, said first axial rod going through said eyelets on said second segment and said eyelets on said third segment, said eyelets on said second segment and said eyelets on said third segment being interleaved with each other; and a plurality of said links interconnected together to form an endless loop, each of said links being connected by an axial rod from said plurality of axial rods going through said eyelets on said fourth segment of a first link in said plurality of links and said eyelets on said first segment of an adjacent link in said plurality of links, said eyelets on said first segment and said eyelets on said fourth segment being interleaved with each other.

In an embodiment of the conveyor chain, the plurality of links includes at least four links and may include eight links.

In an embodiment of the conveyor chain, all the hinges in said plurality of hinges are on an inside of said endless loop.

In an embodiment of the conveyor chain, each of said segments in said plurality of segments is generally identical to all other segments in said plurality of segments.

In an embodiment of the conveyor chain, each of said edges is generally perpendicular to at least one of said top surface or said bottom surface.

In an embodiment of the conveyor chain, each of said edges is generally perpendicular to both said top surface and said bottom surface.

In an embodiment of the conveyor chain, each of said angled faces is generally flat.

In an embodiment of the conveyor chain, each of said angled faces is sawtoothed.

In an embodiment of the conveyor chain, each of said angled faces is stepped.

There is also described herein, an embodiment of a stairmill comprising: a support structure; two independent tracks attached to said support structure; and a conveyor chain comprising: a plurality of segments, each of said segments comprising a main body in the shape of a trapezoidal prism, said main body including: a top surface; a bottom surface smaller than said top surface and generally parallel thereto; an angled face interconnecting said top surface and said bottom surface; and an edge also interconnecting said top surface and said bottom surface; wherein, said edge and said angled face are not parallel to each other; and wherein said edge has a plurality of eyelets arranged thereon; a plurality of axial rods; and a plurality of hinges; wherein, said plurality of segments are arranged into a conveyor chain with: a first segment from said plurality of segments connected to a second segment from said plurality of segments to form a tread, said first segment and said second segment being connected by a first hinge from said plurality of hinges arranged at a bottom surface of said first segment and a top surface of said second segment so that the angled faces of said first segment and said second segment can alternatively be in contact with each other and not in contact with each other; a third segment from said plurality of segments connected to a fourth segment from said plurality of segments to form a kickplate, said third segment and said fourth segment being connected by a second hinge from said plurality of hinges arranged at a top surface of said third segment and a bottom surface of said fourth segment so that the angled faces of said third segment and said fourth segment can alternatively be in contact with each other and not in contact with each other; said tread and said kickplate connected together to form a link, said tread and said kickplate being connected by a first axial rod from said plurality of axial rods, said first axial rod going through said eyelets on said second segment and said eyelets on said third segment, said eyelets on said second segment and said eyelets on said third segment being interleaved with each other; and a plurality of said links interconnected together to form an endless loop, each of said links being connected by an axial rod from said plurality of axial rods going through said eyelets on said fourth segment of a first link in said plurality of links and said eyelets on said first segment of an adjacent link in said plurality of links, said eyelets on said first segment and said eyelets on said fourth segment being interleaved with each other; wherein said axial rods between said tread and said kickplate are connected to a first of said two independent tracks; and wherein said axial rods between each of said plurality of links are connected to a second of said two independent tracks.

In an embodiment of the stepmill, the plurality of links includes at least four links and may include eight links.

In an embodiment of the stepmill, all the hinges in said plurality of hinges are on an inside of said endless loop.

In an embodiment of the stepmill, each of said segments in said plurality of segments is generally identical to all other segments in said plurality of segments.

In an embodiment of the stepmill, each of said edges is generally perpendicular to at least one of said top surface or said bottom surface.

In an embodiment of the stepmill, each of said edges is generally perpendicular to both said top surface and said bottom surface.

In an embodiment of the stepmill, each of said angled faces is generally flat.

In an embodiment of the stepmill, each of said angled faces is sawtoothed.

In an embodiment of the stepmill, each of said angled faces is stepped.

DESCRIPTION OF THE PREFERRED EMBODIMENT(S)

Figure 1:
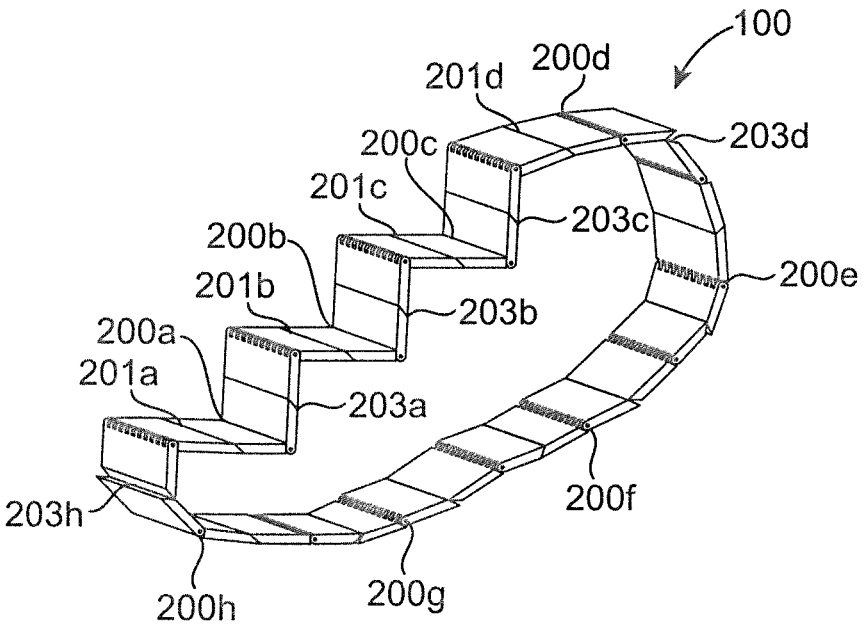
FIG. 1 shows a side perspective view of an embodiment of a conveyor chain as it would be on a stepmill, but removed from all other components.

It is helpful to provide some general terminology that will be used herein. Generally, this disclosure is concerned with a conveyor chain that can be formed into stair steps. Stair steps are well understood by one of ordinary skill in the art and generally have two surfaces that are visible to a user, a "tread", which is generally horizontal and upon which a user will place their foot when climbing the steps and a "kickplate" that serves to interconnect adjacent treads and provides the vertical separation between them. The kickplate also serves to prevent a user's foot from extending underneath the next tread. It should be recognized that is some forms of stairs, the kickplate is not present for aesthetic reasons. However, a stepmill will generally have a kickplate to eliminate a potential pinch hazard between adjacent treads and to provide for a continuous chain shape. Further, one of ordinary skill in the art generally understands what the top of a staircase is and the bottom of a staircase is.

A stepmill is an exercise device which provides for a moving belt or chain which provides a small staircase (generally having between 3 and 5 treads of steps) where the belt or chain which forms the steps can move backwards (downwards) making the staircase effectively endless. Stairs will generally become available to the user at the top of the staircase and the steps will disappear under the staircase at the bottom. The user will walk on treads that are within the middle which provide a sturdy base and generally hold their relative positions to each other.

To provide for the endless loop operation, the belt or chain of the stepmill causes the elements forming the staircase to return from the bottom of the staircase to the top of the staircase generally underneath the staircase as visible to the user. This makes the staircase "endless" from the point of view of the user. As the user steps up a step, the step simultaneously moves downward. Generally, the user will walk forwards up the staircase formed by a stepmill, but this is by no means required.

A conveyor chain of the type used in a stepmill is an endless loop comprising a series of links that are connected together. This is as opposed to a belt comprising a single looped piece of material. Each link of a conveyor chain will be connected to the next and prior link via a rotational connection with the first and last link interconnected to form a loop. This allows the links to freely rotate relative to each other. It should be recognized that links are considered to repeat in a chain, thus, a link may be made up of one or more components which also rotate relative to each other, but which do not repeat. That is, a "link" as used herein comprises one piece of the chain that, when multiple identical links are interconnected, form the conveyor chain.

In the present disclosure, each link of the conveyor chain (100) will correspond to a single "step" of the system. Thus, the chain (100) of FIG. 1 comprises eight links (200), each of those links is formed of two elements (a tread (201) and a kickplate (203)) and each of the two elements is comprised of two segments (300). A single link (200) is shown in FIG. 2 and a single segment (300) is shown in FIG. 3.

A step, as used herein, generally will comprise two elements. The first element will generally be substantially horizontal and will comprise a tread (201) that the user will step onto by placing their foot flat on it. The step then also comprises a substantially vertical element that is the kickplate (203). It should be recognized that the generally horizontal and generally vertical positions of the tread (201) and kickplate (203) are when the link forms a step as in FIG. 2. At alternative times, the relative positions and arrangements of the tread (201) and kickplate (203) are different, but the elements (201) and (203) will always be arranged in the same arrangement when the link (200) forms a step.

In forming the conveyor chain, a lower step's tread (201) element will be connected toward the bottom (231) of the lower step's kickplate (203) at a first end (213) of the tread (201) while the top (233) of the kickplate (203) will be connected to the immediately higher step's tread (201) element at the second end (211), which is opposite the first (213). In this way, the series of links, when in their step configuration, will essentially form a series of interconnected "L's" when viewed from the side.

Figure 2:
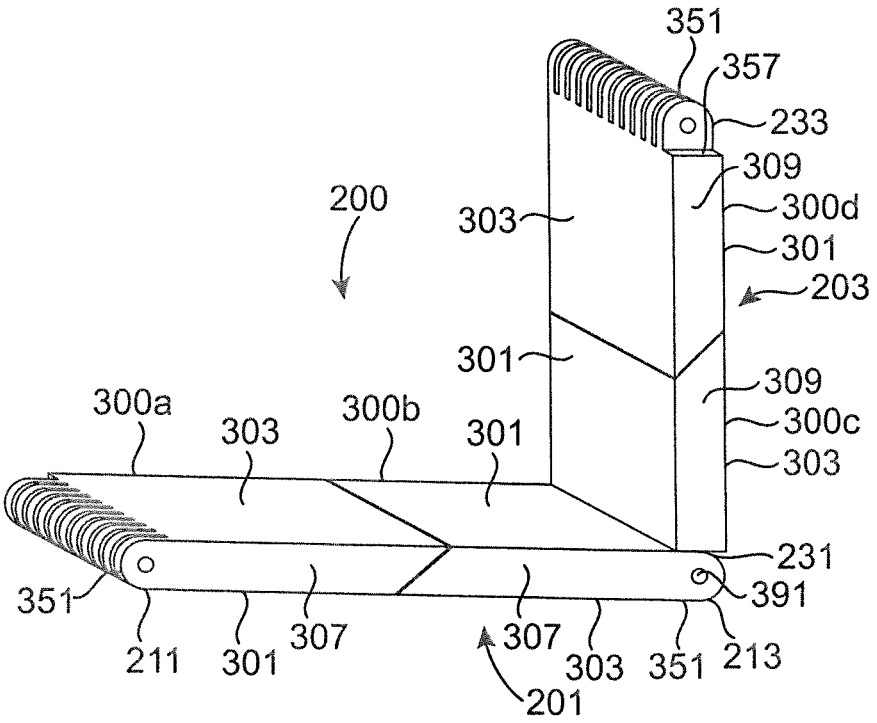
FIG. 2 shows a side perspective view of a single link of a conveyor chain that uses four identical segments to form a single stair.
Figure 3:
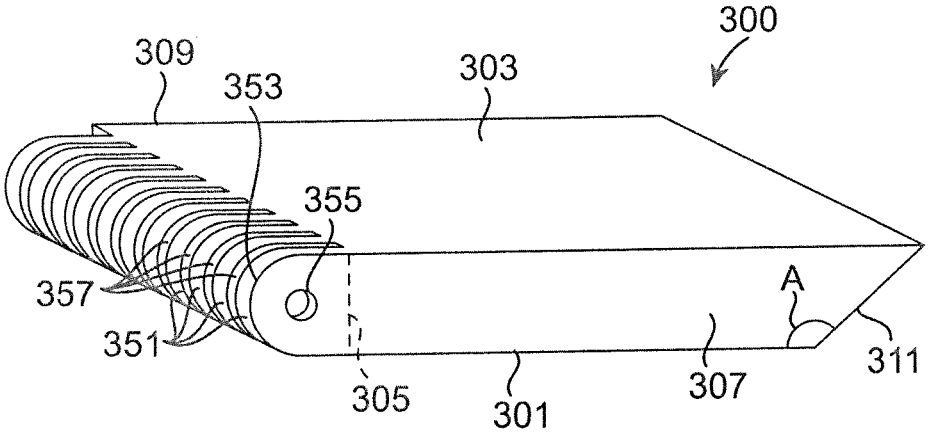
FIG. 3 shows a side perspective view of a single segment of the conveyor chain of FIG. 2.

FIG. 2 provides for a detailed view of a single link (200) of an embodiment of the conveyor chain. As can be seen in FIG. 2, each link (200) forms a tread (201) and kickplate (203), but each of the tread (201) and kickplate (203) are formed from two segments (300*a*), (300*b*), (300*c*), and (300*d*). Each segment (300*a*), (300*b*), (300*c*), and (300*d*) however is generally identical to each other segment (300*a*), (300*b*), (300*c*), and (300*d*) and each comprises the segment (300) of FIG. 3. As should be apparent from FIG. 2, the segments (300*a*), (300*b*), (300*c*), and (300*d*) are simply multiples of segment (300) arranged in different positions.

As shown in FIG. 3, each segment (300) will generally be comprised of a main body (302) that is generally in the shape of a trapezoidal prism. The two generally parallel major surfaces of the prism are referred to as the top (303), which is the larger of the parallel surfaces, and the bottom (301) which is the smaller. With regards to the non-parallel surfaces, one of these will generally be arranged to be generally perpendicular to at least one of the two major surfaces and is referred to as the edge (305).

The edge (305) has a plurality of repeating eyelets (351) extending therefrom. Each of the eyelets (351) comprises a generally rounded surface (353) on the end opposing the edge (305) and a single hole (355) therethrough. The eyelets (351) will be arranged in a spaced arrangement from each other with gaps (357) between. Each gap (357) is of generally the same width as the width of the each eyelet (351) where the width is measured in the dimension parallel to the edge (305). The plurality of eyelets (351) are also offset from one side of the prism along the width of the edge (305) so that on one side (307) an eyelet (305) is generally flush with the side (307) of the prism, while on the other side (309) a gap (357) is generally flush with the side (309) of the prism.

The other non-parallel surface of the segment (300) extends outward at a first angle (A) from the bottom surface (301) and is referred to as the angled face (311). In an embodiment, angle (A) is around 135 degrees but alternative angles of virtually any amount can be used in alternative embodiments so long as the angle (A) is greater than 90 degrees. The angled face (311) will generally have a greater surface area than the edge (309), but this is not required. The angled face (311) will generally not be planar to the edge (305) to the extent that the edge is, in many respects, a conceptual surface in the main body (302).

While the angled face (311) will generally comprise a generally planar flat surface, this is by no means required. In an alternative embodiment, the angled face (311) may comprise a stepped or sawtoothed pattern formed from virtually any shape extending from the generally planar surface. The angled face (311) is generally only required to be able to effectively interface with another angled face (311) on an opposing arranged segment (300) as discussed in conjunction with FIG. 2.

The segments (300) of FIG. 3 are designed to interface with each other as shown in FIG. 2. Specifically, four segments (300*a*), (300*b*), (300*c*), and (300*d*) are positioned as shown in FIG. 2 to form a single link (200). The first segment (300*a*) is arranged with the top (303) upward (that is toward the upper portion of the page) and side (307) toward the viewer so that the angled face (311) is directed downward. The second segment (300*b*) is then arranged vertically flipped so that the bottom (301) is toward the upper portion of the page and the angled face (311) is facing upward. However, the second segment (300*b*) is not horizontally flipped relative to the first segment (300*a*) as the side (307) still faces the user. The angled face (311) of the first segment (300*a*) is adjacent to and in contact with the angled face (311) of the second segment (300*b*) which essentially intermesh due to the relationship of the angles (A) and any toothed or similar pattern thereon.

The second segment (300*b*) is then connected via its eyelets (351) by an axial rod (391) being placed through the eyelets (351) of the second segment (300*b*) and the eyelets (351) of the third segment (300*c*) which are interleaved with each other. Because the eyelets (351) are offset on the edges (309), the third segment (300*c*) is horizontally flipped, but not vertically flipped, compared to the second segment (300*b*) and has the side (309) facing the user. The third segment (300*c*), however, is still positioned with the bottom (301) upward which in the FIG. is toward the left of the page due to the third segment (300*c*) being rotated generally 90 degrees to the second segment (300*b*) about the axial rod (391). As should be apparent, the third segment (300*c*) can freely rotate about the axis defined by the axial rod (391) relative to the second segment (300*b*).

The fourth segment (300*d*) is arranged vertically flipped, but not horizontally flipped, relative to the third segment (300*c*) with the angled face (311) of the fourth segment (300*d*) in contact with the angled face (311) of the third segment (300*c*). This results in the top (303) being upward or toward the left of the page in FIG. 2 with the side (309) being toward the viewer.

It should be apparent from FIG. 2 that the positions of the eyelets on the fourth segment (300*d*) are such that they would intermesh with the eyelets (351) on the first segment (300*a*). This interconnection between the fourth segment (300*d*) of a first link (200*a*) and the first segment (300*a*) of a second link (200*b*) allows two consecutive links to be connected with another axial rod (391) as can be seen in FIG. 1. As is also shown in FIG. 1, the pattern of links (200) is repeated until a chain (100) with the desired number of links (200) is assembled. At this time, the fourth segment (300*d*) of the last link is connected with the first segment (300*a*) of the first link to form an endless chain (100). As should be apparent from FIG. 1, the upward side of each link (200) in FIG. 2 generally forms the outer surface of the chain (100) while the downward side generally forms the inner surface of the chain (100).

Figure 4:
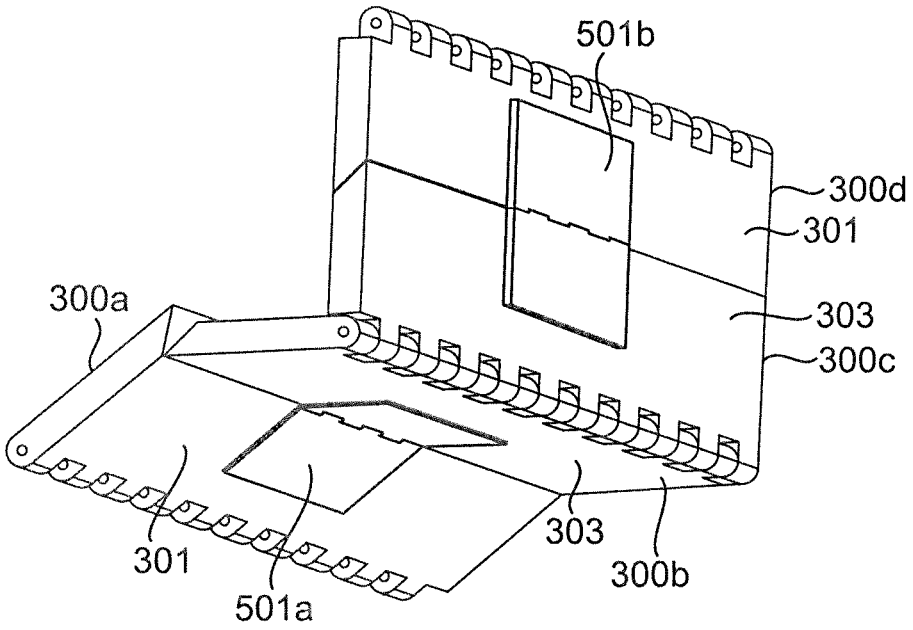
FIG. 4 shows an underside view of the link of FIG. 2 illustrating the mating hinges of each of the two segments forming each of the elements of the link.

As can be best seen in FIG. 4, the angled faces within the two segments (300) in each element are further interconnected by a hinge (501). The hinges (501) are generally on the inside surface of the chain (100) (the downward surfaces of FIG. 2) and provide the chain (100) strength. The hinges (501) are of generally similar design and the first hinge (501*a*) interconnects the first segment (300*a*) with the second segment (300*b*) while the second hinge (501*b*) interconnects the third segment (300*c*) with the fourth segment (300*d*). Each hinge (501) is arranged to bend at the line of intersection at the downward sides of the angle faces (311) of the two segments so their angled faces (311) are alternatively in contact with each other and not in contact with each other. The first hinge (501*a*) is attached to the bottom surface (301) of the first segment (300*a*) and the top surface (303) of the second segment (300*b*) with the hinge (501*a*) positioned to bend at the line of intersection between to the bottom surface (301) of the first segment (300*a*) and the top surface (303) of the second segment (300*b*). The second hinge (501*b*) is attached to the bottom surface (301) of the fourth segment (300*d*) and the top surface (303) of the third segment (300*c*) with the hinge (501*b*) positioned to bend at the line of intersection between to the bottom surface (301) of the fourth segment (300*d*) and the top surface (303) of the third segment (300*c*).

Figure 5:
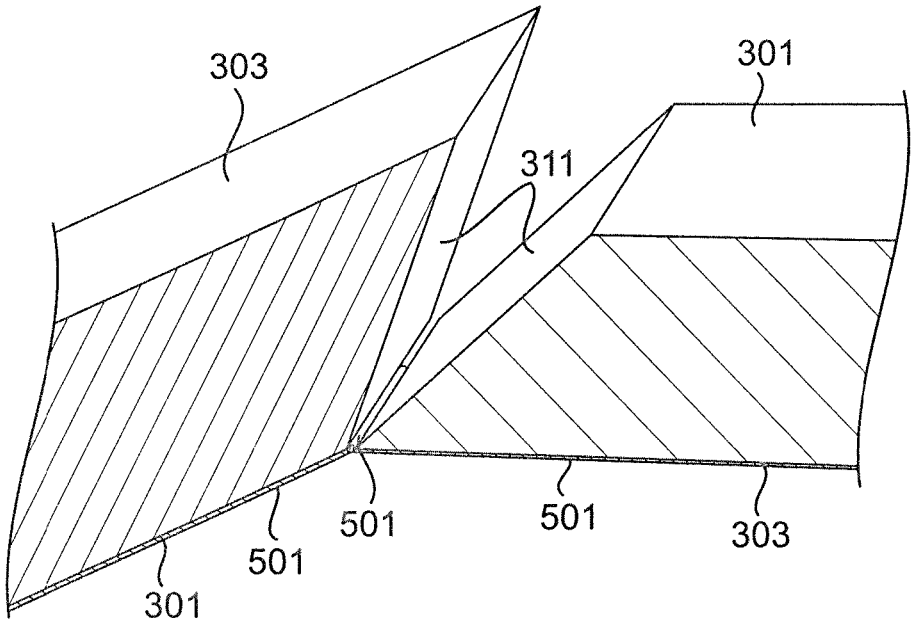
FIG. 5 shows the bend of two adjacent segments about the mating hinge.

As should be apparent from FIG. 4, the positioning of the hinges (501) allows for each of the segments (300) within each element (the tread (201) and the kickplate (203)) to rotate in only one direction relative to the other segment (300) in the same element. This direction, as shown in FIG. 5 is where the two angled faces (311) move away from each other and, as can be best seen from FIG. 1, allows the segments (300) to bend generally downward in the directionality of FIG. 2 to be able to form the loop of FIG. 1. Further, because of the axial rod (391) and eyelet (351) arrangement both within a link (300) (between second segment (300*b*) and third segment (300*c*)) and between links (300) (between the first segment (300*a*) on a second link (200*b*) and the fourth segment (300*d*) on a first link (200*a*)) each tread element (201) can freely rotate either direction relative to the kickplate element (203) within a link (300), and each link can freely rotate in either direction relative the two other links (300) to which it is attached. This should be apparent by the myriad of different relative positions of the eight links (200) shown in FIG. 1.

FIG. 1 best illustrates the movement of the chain (100) in creating a stair arrangement for exercising. In FIG. 1, there are shown three links (200*a*), (200*b*) and (200*c*) which are positioned in their "L" position of FIG. 2. Each of these links forms a stair of the chain (100) where a user can place their foot on the tread surfaces (201*a*), (201*b*), and (201*c*). Further, a fourth tread surface (201*d*) is in the process of forming at the top of the staircase. Each of the tread surfaces (201*a*), (201*b*), (201*c*), and (201*d*) is interconnected by a kickplate (203*a*), (203*b*), and (203*c*). There are then five additional links (200*d*), (200*e*), (200*f*), (200*g*), and (200*h*) which are arranged in various states of bending at their hinges (501) and/or eyelet (351) and rod (391) connections.

As can be seen in FIG. 1 the fourth kickplate (203*d*) is currently bent downward (inward on the chain (101)) within the kickplate element (203*d*) as the fourth link (200*d*) is coming over the top of the stepmill and a eighth kickplate (203*g*) is also bent inward on the chain (101) as the eighth link (200*h*) is turning under the bottom of the stepmill. The remaining links (200*e*), (200*f*) and (200*g*) are arranged to form a roughly flat arrangement when they are under the stair area moving from the bottom sprocket to the top. This arrangement is much thinner than the step arrangement of links (200*a*), (200*b*), and (200*c*).

As should be apparent from FIG. 1, the chain (100) allows for a substantial reduction in the height of the lowest portion of the chain (100) when it is mounted in a housing. In particular, the link at the very bottom (the eighth link (200*h*) of FIG. 1) allows the link to turn in a space generally equal to or less than the combined depth of two segments (300) (although slightly larger amounts may be used in an embodiment due to other requirements of the stepmill). This allows for the bottom tread of the stepmill to generally be closer to the ground than with designs where the tread and kickplate are each a monolithic piece, or where the step link (tread and kickplate combined) are each formed as a monolithic piece.

Figure 6:
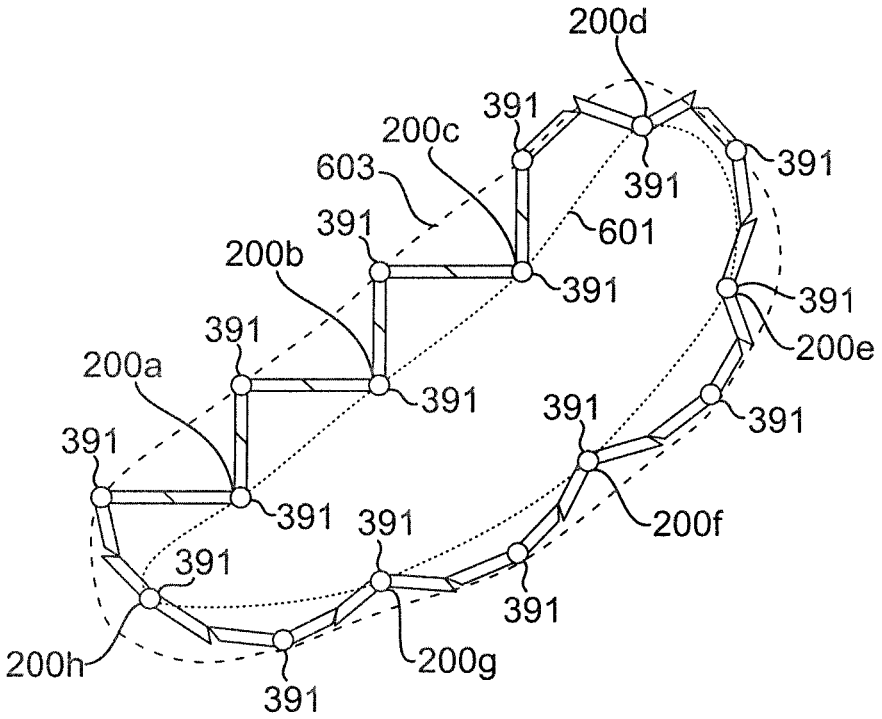
FIG. 6 shows side view of the chain of FIG. 1 with an illustration of the location of support tracks to carry and support the chain.

In order to provide good support for the weight of a user walking on the links (200) in the step configuration, the links (200) will generally be carried on two independent tracks (601) and (603) as shown in FIG. 6. The tracks (601) and (603) are mounted to a support structure (not shown) of a typical type to support a conveyor chain stairmill belt. In the arrangement of FIG. 6, each of the axial rods (391) within the links (200) are connected to track (601) while each of axial rods (391) between links (200) are connected to track (603). This means that as each link (200) comes into position at the top of the device, the links (200) will naturally be positioned in the step arrangement shown due to the distance between the tracks (601) and (603) at that point. Further, when a user stands on the tread (201) of a link (200), their weight is distributed between the two tracks (601) and (603) and two rods (391) with each of the treads (201) supported at each end (211) and (213) by a separate track (601) and (603) respectively.

Further, as can be best seen in FIGS. 2-5, in the tread arrangement, the two segments (300*a*) and (300*b*) of the tread (201) will push against each other and resist splitting at their angled faces (311) as the faces (311) are compressed together by the mass of the user. Splitting between the segments of the tread (201) is actually resisted by two separate components, firstly by the angled faces (311) compressing together and secondly by the hinge (501*a*) which will generally not be designed to rotate in that direction. However, the hinge (501*a*) is not under extreme duress from the mass of the user trying to rotate it in an opposing direction. Instead, the angled faces (311) (along with the surface of the tread itself) spread the mass of the user across a fairly wide area. It should be recognized that while the embodiments of the drawings provide for a fairly steep angle (A) for the angled faces (311), these faces can be a lot longer by using an angled face (311) with a greater surface area and a more shallowly angled face (311).

Throughout this disclosure, relative terms such as "generally," "about," and "approximately" may be used, such as, but not necessarily limited to, with respect to shapes, sizes, dimensions, angles, and distances. One of ordinary skill will understand that, in the context of this disclosure, these terms are used to describe a recognizable attempt to conform a device to the qualified term. By way of example and not limitation, components such as surfaces described as being "generally planar" will be recognized by one of ordinary skill in the art to not be, in a strict geometric sense, planar, because in a real world manufactured item a surface is generally never truly planar as a "plane" is a purely geometric construct that does not actually exist, and no component is truly "planer" in the geometric sense. Thus, no two components of a real item are ever truly planar, as they exist outside of perfect mathematical representation. Variations from geometric descriptions are inescapable due to, among other things: manufacturing tolerances resulting in shape variations, defects, and imperfections; non-uniform thermal expansion; design and manufacturing limitations, and natural wear. There exists for every object a level of magnification at which geometric descriptors no longer apply due to the nature of matter. One of ordinary skill will understand how to apply relative terms such as "generally," "about," and "approximately" to describe a range of variations from the literal meaning of the qualified term in view of these and other considerations.

Further, use in this description of terms such as "upward" and "downward" do not actually require that certain surfaces or objects be closer or further away from a surface upon which an exercise machine is resting at any given time. Instead, they are generally used to denote opposite directions in conjunction with the standard arrangement of the FIGS. provided herein so as to give relative positioning of elements. Similarly, terms such as "inward" and "outward", "left" and "right", and "top" and "bottom" are used to show relative directions or positions as opposed to absolute location.

While the invention has been disclosed in conjunction with a description of certain embodiments, including those that are currently believed to be the preferred embodiments, the detailed description is intended to be merely illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A conveyor chain for a stepmill, the chain comprising:

a plurality of segments, each of said segments comprising a main body in the shape of a trapezoidal prism, said main body including:

a top surface;

a bottom surface smaller than said top surface and generally parallel thereto;

an angled face interconnecting said top surface and said bottom surface; and an edge also interconnecting said top surface and said bottom surface;

wherein, said edge and said angled face are not parallel to each other; and wherein said edge has a plurality of eyelets arranged thereon;

a plurality of axial rods; and a plurality of hinges;

wherein, said plurality of segments are arranged into a conveyor chain with:

a first segment from said plurality of segments connected to a second segment from said plurality of segments to form a tread, said first segment and said second segment being connected by a first hinge from said plurality of hinges arranged at a bottom surface of said first segment and a top surface of said second segment so that the angled faces of said first segment and said second segment can alternatively be in contact with each other and not in contact with each other;

a third segment from said plurality of segments connected to a fourth segment from said plurality of segments to form a kickplate, said third segment and said fourth segment being connected by a second hinge from said plurality of hinges arranged at a top surface of said third segment and a bottom surface of said fourth segment so that the angled faces of said third segment and said fourth segment can alternatively be in contact with each other and not in contact with each other;

said tread and said kickplate connected together to form a link, said tread and said kickplate being connected by a first axial rod from said plurality of axial rods, said first axial rod going through said eyelets on said second segment and said eyelets on said third segment, said eyelets on said second segment and said eyelets on said third segment being interleaved with each other; and a plurality of said links interconnected together to form an endless loop, each of said links being connected by an axial rod from said plurality of axial rods going through said eyelets on said fourth segment of a first link in said plurality of links and said eyelets on said first segment of an adjacent link in said plurality of links, said eyelets on said first segment and said eyelets on said fourth segment being interleaved with each other.

2. The conveyor chain of claim 1 wherein said plurality of links includes at least four links.

3. The conveyor chain of claim 2 wherein said plurality of links includes eight links.

4. The conveyor chain of claim 1 wherein all said hinges in said plurality of hinges are on an inside of said endless loop.

5. The conveyor chain of claim 1 wherein each of said segments in said plurality of segments is generally identical to all other segments in said plurality of segments.

6. The conveyor chain of claim 1 wherein each of said edges is generally perpendicular to at least one of said top surface or said bottom surface.

7. The conveyor chain of claim 1 wherein each of said edges is generally perpendicular to both said top surface and said bottom surface.

8. The conveyor chain of claim 1 wherein each of said angled faces is generally flat.

9. The conveyor chain of claim 1 wherein each of said angled faces is sawtoothed.

10. The conveyor chain of claim 1 wherein each of said angled faces is stepped.

11. A stepmill comprising:

a support structure;

two independent tracks attached to said support structure; and a conveyor chain comprising:

a plurality of segments, each of said segments comprising a main body in the shape of a trapezoidal prism, said main body including:

a top surface;

a bottom surface smaller than said top surface and generally parallel thereto;

an angled face interconnecting said top surface and said bottom surface; and an edge also interconnecting said top surface and said bottom surface;

wherein, said edge and said angled face are not parallel to each other; and wherein said edge has a plurality of eyelets arranged thereon;

a plurality of axial rods; and a plurality of hinges;

wherein, said plurality of segments are arranged into a conveyor chain with:

a first segment from said plurality of segments connected to a second segment from said plurality of segments to form a tread, said first segment and said second segment being connected by a first hinge from said plurality of hinges arranged at a bottom surface of said first segment and a top surface of said second segment so that the angled faces of said first segment and said second segment can alternatively be in contact with each other and not in contact with each other;

a third segment from said plurality of segments connected to a fourth segment from said plurality of segments to form a kickplate, said third segment and said fourth segment being connected by a second hinge from said plurality of hinges arranged at a top surface of said third segment and a bottom surface of said fourth segment so that the angled faces of said third segment and said fourth segment can alternatively be in contact with each other and not in contact with each other;

said tread and said kickplate connected together to form a link, said tread and said kickplate being connected by a first axial rod from said plurality of axial rods, said first axial rod going through said eyelets on said second segment and said eyelets on said third segment, said eyelets on said second segment and said eyelets on said third segment being interleaved with each other; and a plurality of said links interconnected together to form an endless loop, each of said links being connected by an axial rod from said plurality of axial rods going through said eyelets on said fourth segment of a first link in said plurality of links and said eyelets on said first segment of an adjacent link in said plurality of links, said eyelets on said first segment and said eyelets on said fourth segment being interleaved with each other;

wherein said axial rods between said tread and said kickplate are connected to a first of said two independent tracks; and wherein said axial rods between each of said plurality of links are connected to a second of said two independent tracks.

12. The stepmill of claim 11 wherein said plurality of links includes at least four links.

13. The stepmill of claim 12 wherein said plurality of links includes eight links.

14. The stepmill of claim 11 wherein all said hinges in said plurality of hinges are on an inside of said endless loop.

15. The stepmill of claim 11 wherein each of said segments in said plurality of segments is generally identical to all other segments in said plurality of segments.

16. The stepmill of claim 11 wherein each of said edges is generally perpendicular to at least one of said top surface or said bottom surface.

17. The stepmill of claim 11 wherein each of said edges is generally perpendicular to both said top surface and said bottom surface.

18. The stepmill of claim 11 wherein each of said angled faces is generally flat.

19. The stepmill of claim 11 wherein each of said angled faces is sawtoothed.

20. The stepmill of claim 11 wherein each of said angled faces is stepped.

* * * * *